US012534914B2

(12) United States Patent
Rafferty et al.

(10) Patent No.: US 12,534,914 B2
(45) Date of Patent: Jan. 27, 2026

(54) BRACKET

(71) Applicant: BLOCKAID PTY LTD, Raworth (AU)

(72) Inventors: Christopher Rafferty, Raworth (AU); Craig Thorley, Raworth (AU); Jamie Curran, Raworth (AU); Oliver Kohl, Raworth (AU)

(73) Assignee: BLOCKAID PTY LTD, Raworth (AU)

( * ) Notice: Subject to any disclaimer, the term of this patent is extended or adjusted under 35 U.S.C. 154(b) by 222 days.

(21) Appl. No.: 18/274,664

(22) PCT Filed: Jan. 25, 2022

(86) PCT No.: PCT/AU2022/050035

§ 371 (c)(1),
(2) Date: Jul. 27, 2023

(87) PCT Pub. No.: WO2022/160006

PCT Pub. Date: Aug. 4, 2022

(65) Prior Publication Data

US 2024/0093495 A1 Mar. 21, 2024

(30) Foreign Application Priority Data

Jan. 28, 2021 (AU) ..... 2021200539

(51) Int. Cl.
*E04C 5/16* (2006.01)

(52) U.S. Cl.
CPC ..... *E04C 5/167* (2013.01); *E04C 5/163* (2013.01)

(58) Field of Classification Search
CPC . E04C 5/167; E04C 5/163; E04C 5/16; E04C 5/20
See application file for complete search history.

(56) References Cited

U.S. PATENT DOCUMENTS 3,145,505 A 8/1964 Cornelius
4,190,999 A 3/1980 Hampton
4,831,803 A * 5/1989 Leonardis ..... E04C 5/168 52/577
5,072,556 A * 12/1991 Egenhoefer ..... E04B 2/54 52/421
5,701,710 A * 12/1997 Tremelling ..... E04B 2/8635 52/592.1

(Continued)

FOREIGN PATENT DOCUMENTS

WO WO-2006032100 A1 * 3/2006 ..... E04B 2/20
WO 2009012519 A1 1/2009

OTHER PUBLICATIONS

International Search Report and Written Opinion issued in International Application No. PCT/AU2022/050035, mailed Mar. 31, 2022.

*Primary Examiner* — Adriana Figueroa

(74) *Attorney, Agent, or Firm* — Meunier Carlin & Curfman LLC

(57) ABSTRACT

A bracket for locating a vertical reinforcement bar within a block wall having a central area to enable a reinforcement bar placed vertically through a void of a block wall to pass through the bracket; and a locator for locating the central area in a predetermined position within the void of a block wall; wherein one or more guides extend into the central area to guide one or more reinforcement bars through a central aperture, the central aperture defined by the one or more guides.

19 Claims, 5 Drawing Sheets

(56) References Cited

U.S. PATENT DOCUMENTS

| | | | | |
|---|---|---|---|---|
| 6,571,526 | B2 * | 6/2003 | Queen | E04C 5/168 52/686 |
| 7,007,436 | B1 * | 3/2006 | Kelley | E04B 2/16 52/309.7 |
| 8,458,981 | B2 * | 6/2013 | Kohl | E04B 2/26 52/745.1 |
| 2002/0112437 | A1 | 8/2002 | Queen | |
| 2006/0156646 | A1 | 7/2006 | Evans | |
| 2007/0186504 | A1 * | 8/2007 | Gavin | E04C 5/168 52/677 |

* cited by examiner

BRACKET

CROSS REFERENCE TO RELATED APPLICATIONS

This application is a national stage application filed under 35 U.S.C. § 371 of PCT/AU2022/050035 filed Jan. 25, 2022, which claims priority to and benefit of Australian patent application serial number 2021200539 filed Jan. 28, 2021.

FIELD OF THE INVENTION

This invention relates to a bracket. In particular, the invention relates to an alignment device for block walls for quickly and easily positioning reinforcement bars in a block wall.

BACKGROUND OF THE INVENTION

Concrete blocks are a very popular way in which to build walls of buildings and houses. Traditionally, to produce a concrete block wall, blocks are laid in horizontal courses with horizontal reinforcement bars placed along each course after it is laid. Once all the courses are laid, vertical bars are placed through voids in vertically aligned block cores so that the vertical reinforcement bars extend from adjacent the top of the block wall to adjacent the base of the block wall. Concrete grout is then poured into block voids in the top of the block wall to fill all the voids in the block wall. Once the concrete grout has dried, then the wall is deemed to be a structural reinforced masonry block wall.

Recent modification top the Australian Masonry Standards (AS3700-2018) and Australian National Code of Construction (NCC-2019) have changed what is required to build a block wall. A structural block wall must now have a concrete grout annulus surrounding the vertical reinforcement bar at a thickness of at least twice the diameter of a vertical bar. From a practical perspective, this typically requires the vertical reinforcement bars to be located adjacent the centre of the void of a block when concrete grout is distributed. Currently, physical restraints such as tie bars must be used to prevent the movement of the vertical reinforcement bars. Maintaining the vertical reinforcement in the centre of the voids of the blocks walls and restraining them with the tie bars are challenging tasks and usually are not followed on construction sites. This is largely due to blocks needing to be located over the installed and tied vertical reinforcement bars as the course of blocks are built and also due to the additional labour required to tie off the reinforcement bars at every intersection.

If the construction standards are not met, typically engineers will not certify the block wall's structural capacity. However, for the builders to comply with the construction standards, the time taken to build a wall is greatly increased. This increases the temptation of builders to take short-cuts and hence increases the risk of a catastrophic failure of a block wall.

OBJECT OF THE INVENTION

It is an object of the invention to overcome and/or alleviate one or more of the above disadvantages or provide the consumer with a useful or commercial choice.

It is a preferred object of the invention to provide a more structurally sound block wall by correctly locating the reinforcing bars within the wall.

SUMMARY OF THE INVENTION

In one form, the invention resides in a bracket for locating a longitudinal reinforcement bar within a block wall, the bracket comprising:

- a central area to enable a reinforcement bar placed vertically through a void of a block wall to pass through the bracket; and
- a locator for locating said central area in a predetermined position with the void of a block wall;
- wherein one or more guides extend into the central area to guide one or more reinforcement bars through a central aperture, the central aperture defined by the one or more guides.

The locator may be formed by a frame. The frame may be formed from at least one front wall and at least one side wall that are connected together. Typically, the frame includes two side walls and two end walls that are connected together.

The locator may also include a plurality of locating fingers for holding the bracket within a void of the block wall. The locating fingers may extend outwardly and upwardly on each end of the frame. Typically, the locating fingers extending upwardly and outwardly at an angle from adjacent to a bottom of each end wall. Typically, there are four locating fingers with two locating fingers extending from each end wall.

The locator may also include a plurality of support members to support the bracket on top of a block wall. The support members may extend outwardly on each end of the fame. The locator may include four support members with two support members extending outwardly from adjacent a top of each end wall.

The central area may be defined by one or more central area members. The central area members may be in the form of cross members. The cross members may extend between the two side walls. Typically, there are two cross members.

The central area may be formed from a central opening.

One or more of the guides may extend from one or more of the side walls. One or more of the guides may extend from one or more of the central area members. Typically there are two central area members. Normally there are four guides, with one guide extending from each side wall and one guide extending from the central area members.

The guides may ensure that one or more vertical reinforcement bars are restrained in both a longitudinal and lateral direction within the central aperture.

A guide may be a hinged flap or fixed protrusion. The fixed protrusion may be flexible and maybe in the form of a tab.

One of the side walls may include one or more recess for location of one or more horizontal reinforcement bars. The one or more recesses may both support and restrain one or more horizontal reinforcement bars. The one or more recesses may be located non-centrally on the side wall.

In another form, the invention resides in a block wall system including a block wall having:

- a multiplicity of courses of blocks;
- at least one substantially vertical reinforcement bar that extends through the block wall; and
- at least one bracket for locating the longitudinal reinforcement bar;
- wherein the substantially vertical reinforcement bar passes through the void of at least one block in the block wall and is guided by the guides through a central aperture of a bracket located within the block wall.

In yet another form, the invention resides in a method of forming a block wall, the method including the steps of:

laying a first course of blocks;

locating the bracket within one of the blocks of the first course of blocks;

placing a second course of blocks on top of the first set of blocks; and locating a substantially vertical reinforcement bar through the voids in the first and second course of blocks so that the reinforcement bar is guided by guides through a central aperture of a bracket located within the block wall.

The method may further include the step of locating a substantially horizontal reinforcement bar in a recess of the bracket to support and restrain the bar.

BRIEF DESCRIPTION OF THE DRAWINGS

Embodiments of the invention, by way of example only, will now be described with reference to the accompanying drawings in which.

DETAILED DESCRIPTION OF THE PREFERRED EMBODIMENT

Figure 1A:
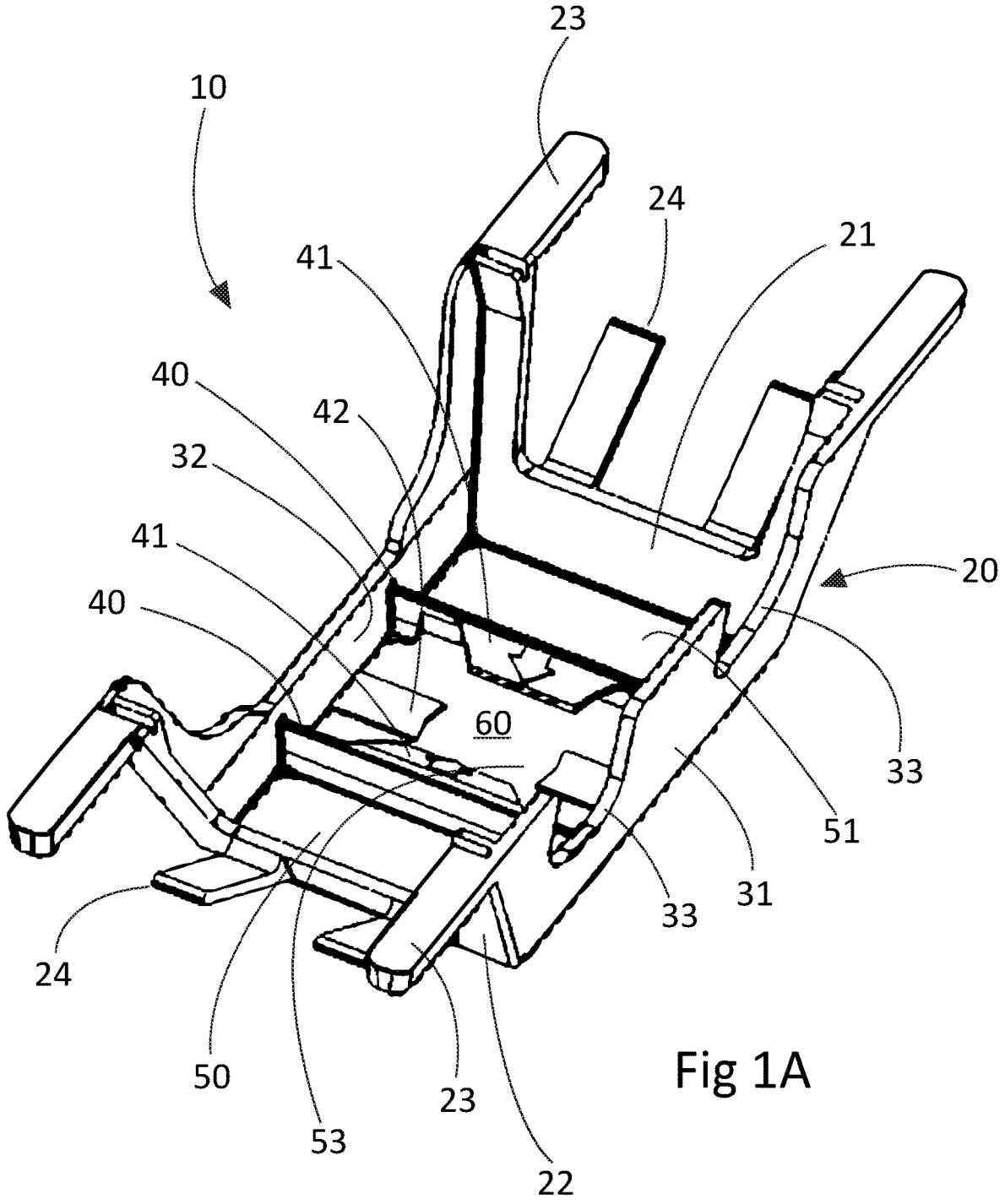
FIG. 1A is a top perspective view of a bracket for the placement of reinforcement bars in a block wall according to a first embodiment of the invention.
Figure 1B:
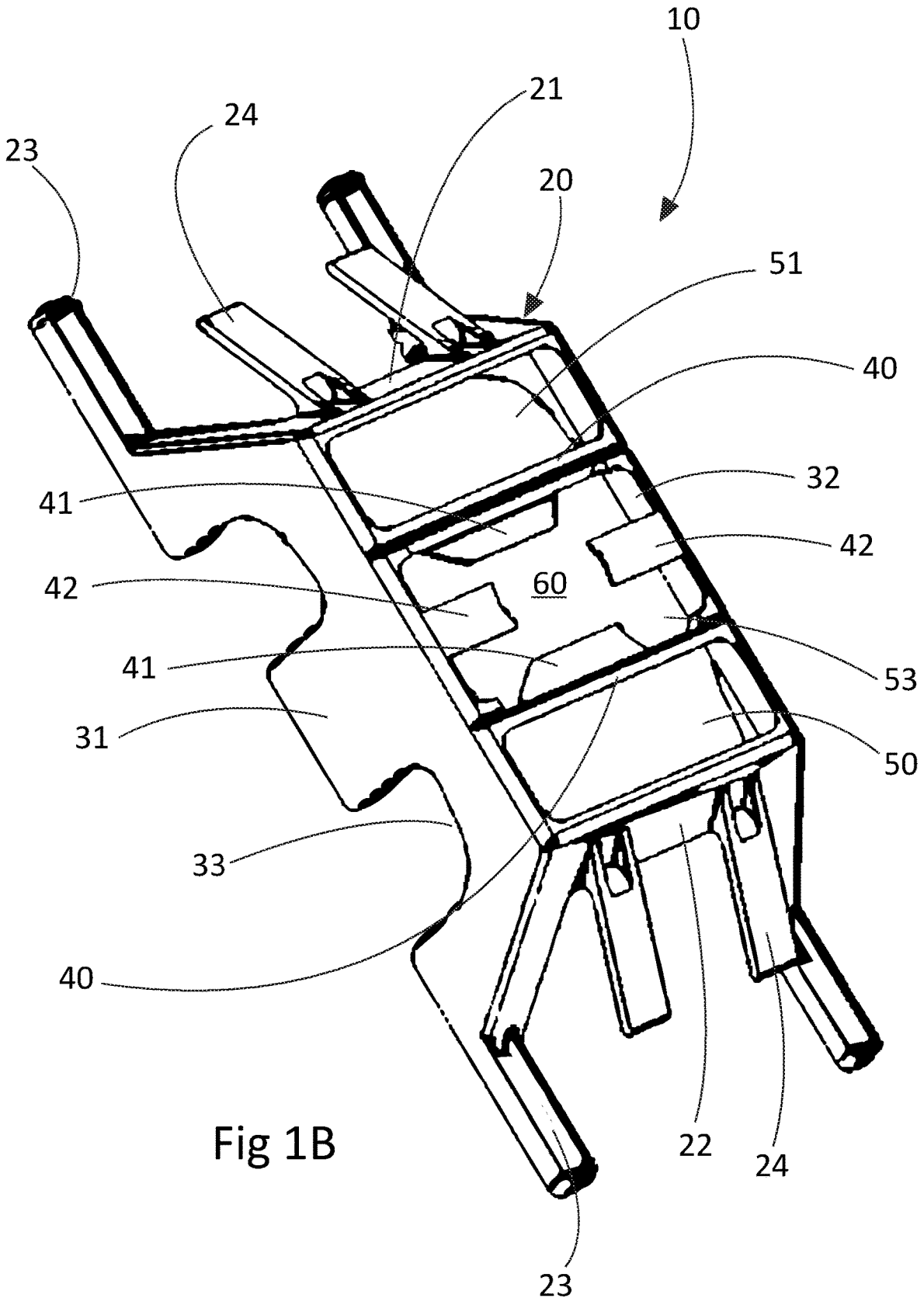
FIG. 1B is a bottom perspective view of a bracket for the placement of reinforcement bars in a block wall according to FIG. 1A.
Figure 1C:
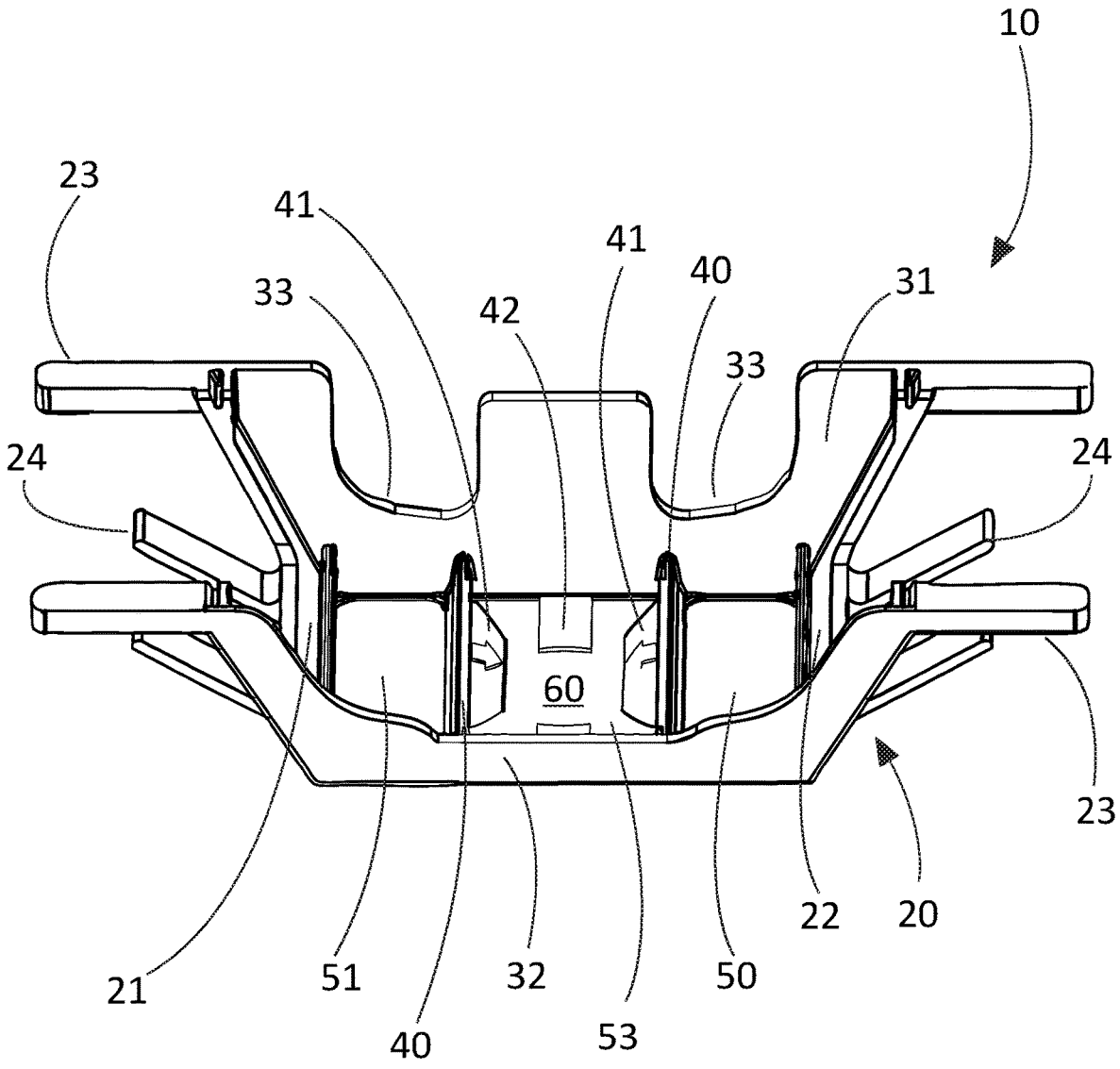
FIG. 1C is a top view of a bracket for the placement of reinforcement bars in a block wall according to FIG. 1A.

FIGS. 1A to 1C show a bracket 10 for positioning vertical reinforcement bars and horizontal reinforcement bars in a block wall. The bracket 10 is typically made from injection mould plastic and accordingly is integrally formed.

The bracket 10 is formed from a frame 20 that includes two end walls 21 and 22, and two side walls 31 and 32. The two end walls 21 and 22, and two side walls 31 and 32, are connected to each other to form corners. The two end walls 21 and 22, and two side walls 31 and 32 are of the same thickness. A base of frame 20 is largely open.

Each end wall 21 is substantially U-shaped. Two support members 23 extend outwardly from adjacent the top of each end wall 21 and 22. The two support members 23 are spaced apart from each other.

Two locating fingers 24 extend outwardly and upwardly at an angle from each end wall 21 and 22. Two locating fingers 24 are connected to their respective end walls 21 and 22 adjacent the base. The two locating fingers 24 on each end wall are spaced apart, elongate and flexible.

One of the side walls 31 is larger than the other side wall 32. Two recess 33 are located in this larger sidewall 31 for the location and support of horizontal reinforcement bars. The recesses are located on the sidewall non-centrally. That is, the recesses are offset compared to a lateral central axis of the frame.

Two cross members 40 extend between the side walls 31 and 32 adjacent the bottom of the side walls 31 and 32. The two cross members 40 are spaced apart and spaced substantially equally spaced from their respective closest end wall 21 and 22. The two cross member 40 define three openings in the base of the frame 20, namely two end openings 50 and 51 and a central opening 53.

A guide, in the form of a flap 41, is attached and hinged adjacent to a centre of each cross member 40. A guide, in the form of a tab 42, is attached adjacent to a centre of each side wall 31 and 32. The end of the tab 42 is arcuate in shape. The ends of the flaps 41 and tabs 42 define a central aperture 60 for the location of one or two vertical reinforcement bars.

Figure 2A:
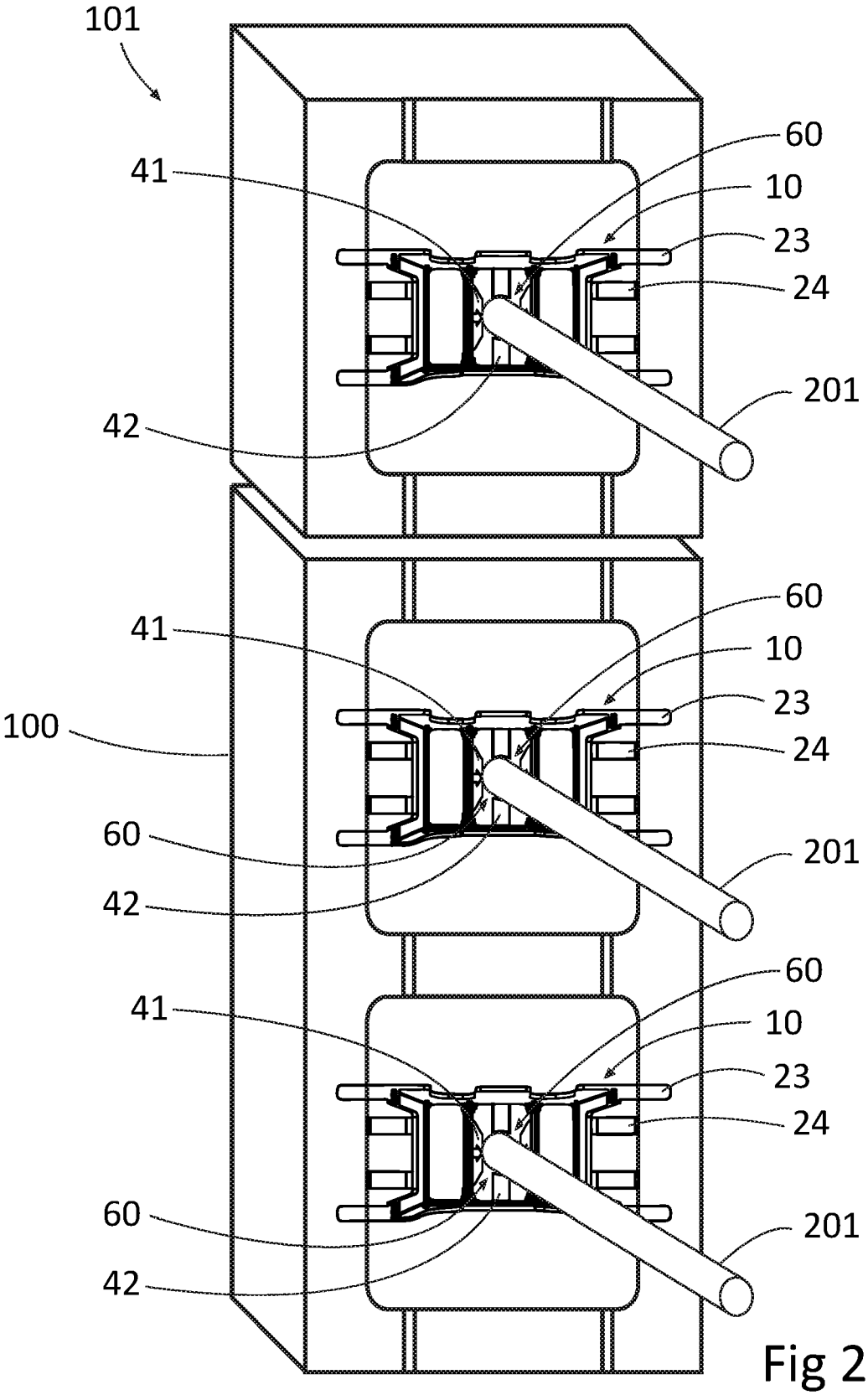
FIG. 2A is a top perspective view of a bracket of FIG. 1A located within a void of a block wall.
Figure 2B:
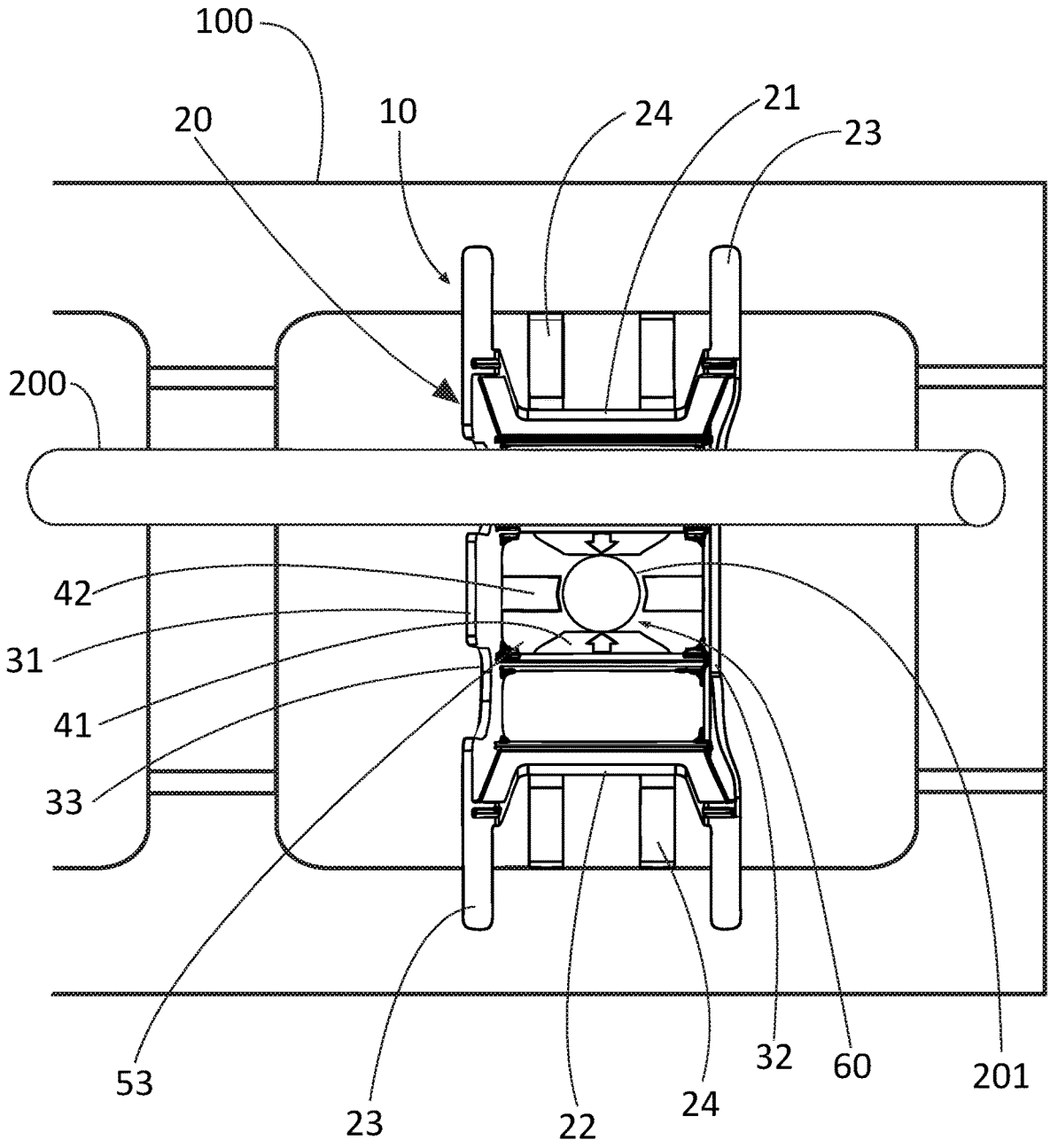
FIG. 2B is a further top perspective view of a bracket of FIG. 1A located within a void of a block wall.

FIGS. 2A and 2B show the bracket 10 shown in FIGS. 1A to 1C in-situ in a void of a block 100 of a block wall 101. To place a bracket 10 within the void of a block 100, the bracket 10 is positioned so that the central aperture 60 is located at the substantially a centre of the void of a block 100 with the support members 23 oriented transverse the longitudinal direction of the block wall 101. Once in this position, the bracket 10 is pushed downwardly into the void of the block 100 until the support members contact the top of the block 100. When the bracket is pushed downwardly, it causes the four locating fingers 24 to deflect and engage internal side walls of the void of the block 100. The locating fingers 24 engagement with the internal side walls of the void hold the bracket 10 centrally within the void and assists in unwanted removal of the bracket 10.

When a horizontal course of blocks 100 has been completed, and the brackets 10 are located within the respective voids, one or two horizontal reinforcement bars 200 are located in respective recesses 33 located in the side wall 31 as shown in FIG. 2B. The recesses 33 both support and restrains horizontal reinforcement bars 200. As the recesses are offset from a lateral central axis of the frame, the horizontal reinforcement bars do not impede, cover or block central opening 53. The next horizontal course of blocks can be laid and the process repeated depending on the structural requirements of the wall. Horizontal bars may not need to be placed in every course.

Once the required number of horizontal courses of blocks 100 are laid, the vertical reinforcement bars 201 are then located within the block wall 101 by lifting each vertical reinforcement bar 201 above the top of the block wall 101.

The vertical reinforcement bars 201 are then located adjacent central opening 53 of the bracket 10. The flaps 41 and the tabs 42 guide the vertical reinforcement bar 201 so that it passes through the central aperture 60 of the bracket. As the bar is pushed further down into the void of the block wall 101, the flaps 41 and tabs 42 ensure that the vertical reinforcement bar 201 passes through the central aperture 60 of each of the bracket 10 in the courses below. Further, the flaps 41 and tabs 42 ensure that the vertical reinforcement bar is restrained in both a longitudinal and lateral direction within the central aperture 60.

Once all of the vertical reinforcement bars 201 are located within the block wall 101, concrete grout is used to fill the voids. The concrete grout is pumped into the voids and is able to surround both the vertical reinforcement bars 201 and horizontal reinforcement bars 200. The flaps 41 and tabs 42 hold and restrain the vertical reinforcement bars 201 in the desired position so that the concrete grout annulus thickness is at least twice the diameter of a vertical bar ensuring that the Australian standards are met. Further, the four locating fingers 24 ensure that the bracket does not move within the void of the block wall 101. The horizontal reinforcement bars 200 are held and restrained in position by the recesses 33 in the side wall 31 whilst the concrete is poured. Once the voids have been filled and the concrete grout has dried, the block wall is completed and deemed to be structurally sound.

To assist in the inspection of the correct placement of the horizontal reinforcement bars 202 and vertical reinforcement bars 201, the brackets 10 may be produced in a bright colour to increase their visibility when looking down the block voids.

The bracket 10 disclosed above enables blocks walls 101 to built simply and quickly without the need for metal ties. This is able to be achieved by enabling the correct location of both the horizontal reinforcement bars 200 and vertical reinforcement bars 201 with little skill or effort. Further, by both locating, holding and restraining horizontal and vertical reinforcement bars in their desired location when concrete grout is poured, bracket 10 ensures block walls 101 achieve compliant strength and durability characteristics.

In this specification, the terms "comprise", "comprises", "comprising" or similar terms are intended to mean a non-exclusive inclusion, such that a system, method or apparatus that comprises a list of elements does not include those elements solely but may well include other elements not listed.

In this specification, terms such as upward, downward, horizontal and vertical, and their grammatical derivatives, are used to describe the invention in its normal orientation and are not construed to limit the invention to any particular orientation.

The reference to any prior art in this specification is not, and should not be taken as, an acknowledgement or any form of suggestion that the prior art forms part of the common general knowledge.

It should be appreciated that various other changes and modifications may be made to the embodiments described without departing from the spirit or scope of the invention.

The invention claimed is:

1. A bracket for locating a vertical reinforcement bar within a block wall, the bracket comprising:

a central area to enable a reinforcement bar placed vertically through a void of a block wall to pass through the bracket; and a locator for locating said central area in a predetermined position with the void of the block wall;

wherein one or more guides extend into the central area to guide one or more reinforcement bars through a central aperture, the central aperture defined by the one or more guides, and wherein at least one of the one or more guides extend from a center of at least one side wall.

2. The bracket of claim 1 wherein the locator is formed by a frame.

3. The bracket of claim 2 wherein the frame is formed from at least one front wall and one or more of the at least one side wall.

4. The bracket of claim 2 wherein the frame includes two of the at least one side walls and two end walls that are connected together.

5. The bracket of claim 4 wherein the locator includes a plurality of locating fingers for holding the bracket centrally within the void of the block wall.

6. The bracket of claim 1 wherein the locator includes a plurality of support members to support the bracket on top of a block of the block wall, the plurality of support members extending outwardly on each end of a frame.

7. The bracket of claim 1 wherein the central area is defined by one or more central area members.

8. The bracket of claim 7 wherein the one or more central area members are cross members that extend between two side walls.

9. The bracket of claim 1 wherein the central area is formed from a central opening.

10. The bracket of claim 8 wherein one or more of the one or more guides extend from one or more of the one or more central area members.

11. The bracket of claim 1 wherein the one or more guides are a hinged flap or fixed protrusion.

12. The bracket of claim 3 wherein one of the at least one side wall includes one or more recess for location of one or more horizontal reinforcement bars.

13. The bracket of claim 12 wherein one or more recesses are located non-centrally on the at least one side wall.

14. A block wall system including a block wall having:

a multiplicity of courses of blocks;

at least one substantially vertical reinforcement bar that extends through the block wall; and at least one bracket for locating the at least one substantially vertical reinforcement bar;

wherein the at least one substantially vertical reinforcement bar passes through a void of at least one block in the block wall and is guided by one or more guides of the at least one bracket through a central aperture of the at least one bracket located within the block wall, wherein at least one of the one or more guides extend from a center of at least one side wall of the at least one bracket.

15. The block wall system of claim 14 further including a substantially horizontal reinforcement bar located on the at least one bracket so that the at least one bracket supports and restrains the substantially horizontal reinforcement bar without covering the central aperture.

16. The block wall system of claim 14 wherein the at least one bracket restrains the at least one substantially vertical reinforcement bar in both a longitudinal and lateral direction within the central aperture.

17. A method of forming a block wall, the method including the steps of:

laying a first course of blocks;

locating a bracket within one block of the first course of blocks;

placing a second course of blocks on top of the first course of blocks; and locating a substantially vertical reinforcement bar through voids in the first and second course of blocks so that the substantially vertical reinforcement bar is guided by one or more guides through a central aperture of the bracket located within the block wall, wherein at least one of the one or more guides extend from a center of at least one side wall of the bracket.

18. The method of claim 17 further including the step of locating a substantially horizontal reinforcement bar on the bracket so that the bracket supports and restrains the substantially horizontal reinforcement bar without covering the central aperture.

19. The method of claim 17 wherein the bracket restrains the substantially vertical reinforcement bar in both a longitudinal and lateral direction within the central aperture.

* * * * *